United States Patent [19]

Atzmon et al.

[11] Patent Number: 4,640,816

[45] Date of Patent: Feb. 3, 1987

[54] METASTABLE ALLOY MATERIALS PRODUCED BY SOLID STATE REACTION OF COMPACTED, MECHANICALLY DEFORMED MIXTURES

[75] Inventors: Michael Atzmon, Herzlia, Israel; William L. Johnson, Pasadena, Calif.; John D. Verhoeven, Ames, Iowa

[73] Assignee: California Institute of Technology, Pasadena, Calif.

[21] Appl. No.: 645,847

[22] Filed: Aug. 31, 1984

[51] Int. Cl.[4] ..... B22F 1/00

[52] U.S. Cl. ..... 419/24; 419/23; 419/38; 419/43; 419/45; 419/46; 148/403; 29/599

[58] Field of Search ..... 419/69, 24, 46, 45, 419/43; 148/13.1, 13.2, 14, 1, 11.5 P, 11.5 Q, 11.5 N, 11.5 C, 403; 29/599

[56] References Cited

U.S. PATENT DOCUMENTS

| | | | |
|---|---|---|---|
| 3,473,217 | 10/1969 | Prior | 419/8 X |
| 3,681,063 | 8/1972 | Douglass | 419/24 X |
| 3,733,692 | 5/1973 | Fietz et al. | 29/599 |
| 3,815,224 | 6/1974 | Pickus et al. | 29/599 |
| 3,876,473 | 4/1975 | McDougall | 148/11.5 Q |
| 4,093,453 | 6/1978 | Makino et al. | 148/1 X |
| 4,094,059 | 6/1978 | Tachikawa et al. | 29/599 |
| 4,148,669 | 4/1979 | Tanner et al. | 148/13.2 |
| 4,224,735 | 9/1980 | Young et al. | 148/11.5 Q X |
| 4,250,229 | 2/1981 | Kear et al. | 428/606 |
| 4,285,740 | 8/1981 | Young et al. | 148/11.5 Q |
| 4,362,582 | 12/1982 | Danko | 148/127 |
| 4,431,604 | 2/1984 | Sata et al. | 419/35 X |
| 4,564,396 | 1/1986 | Johnson et al. | 148/4 |

OTHER PUBLICATIONS

Clemens, B. M. "Amorphous Zirconium-Nickel Films Formed by Solid State Reactions" *J. Non-Crystalline Solids* V. 61 & 62 (1984) Apr. 1, 1984, pp. 817-822.

Schwarz, et al. "A Study of Amorphous Alloys of Au with Group IIIA Elements (Y and La) Formed by a Solid State Diffusion Reaction" *J. Non Cryst. Sol.* V. 61 & 62 (1984) pp. 129-134.

LeClaire, A. D. "Solute Diffusion in Dilute Alloys" *J. Nucl. Materials* V. 69 & 70 (1978) pp. 70-96.

Dariel, et al. "Self-Diffusion and Solute Diffusion of Gold in F.C.C. Lanthanum" *Philos. Mag.* V. 19 (1969) pp. 1053-1059.

German, R. M. "Diffusional Activated Sintering-Densification, Microstructure and Mechnical Properties" *Int. J. Powd. Met. & Powd. Tech.* vol. 19(4) (1983) pp. 277-287.

Koch, et al. "Preparation of 'Amorphous' $Ni_{60}Nb_{40}$ by Mechanical Alloying" *Appl. Phys. Lett.* V. 43(11) (Dec. 1, 1983) pp. 1017-1019.

Schwarz, et al. "Formation of an Amorphous Alloy by Solid-State Reaction of the Pure Polycrystalline Metals" *Phys. Rev. Lett.* V. 51(5) (Aug. 1, 1983) pp. 415-418.

Stein, J. (ed.), *The Random House College Dictionary*, 1980 p. 856.

*Primary Examiner*—John F. Terapane
*Assistant Examiner*—Matthew A. Thexton
*Attorney, Agent, or Firm*—Marvin E. Jacobs

[57] ABSTRACT

Bulk metastable, amorphous or fine crystalline alloy materials are produced by reacting cold-worked, mechanically deformed filamentary precursors such as metal powder mixtures or intercalated metal foils. Cold-working consolidates the metals, increases the interfacial area, lowers the free energy for reaction, and reduces at least one characteristic dimension of the metals. For example, the grains (13) of powder or the sheets of foil are clad in a container (14) to form a disc (10). The disc (10) is cold-rolled between the nip (16) of rollers (18,20) to form a flattened disc (22). The grains (13) are further elongated by further rolling to form a very thin sheet (26) of a lamellar filamentary structure (FIG. 4) containing filaments having a thickness of less than 0.01 microns. Thus, diffusion distance and time for reaction are substantially reduced when the flattened foil (28) is thermally treated in oven (32) to form a composite sheet (33) containing metastable material (34) dispersed in unreacted polycrystalline material (36).

15 Claims, 4 Drawing Figures

METASTABLE ALLOY MATERIALS PRODUCED BY SOLID STATE REACTION OF COMPACTED, MECHANICALLY DEFORMED MIXTURES

ORIGIN OF THE INVENTION

The invention described herein was made in performance of work under Project Agreement No. DE-AT03-81ER1070 under Department of Energy Contract No. DE-AM03-765F00767.

TECHNICAL FIELD

The present invention relates to the formation and growth of metastable alloy materials and, more particularly, this invention relates to the production of metastable amorphous and fine crystalline phases by solid-state reaction of a filamentary composite.

BACKGROUND ART

Recent industrial tests of amorphous alloys under realistic working environments have indicated that the wear and corrosion resistances of this new category of alloys are at least one order of magnitude higher than that of conventional alloys currently in use. Other amorphous metal compounds are of interest as superconductors at low temperature and as magnetically soft alloys, etc.

Metallic glasses or, equivalently, amorphous metallic alloys can be formed by rapid solidification of liquid metals, or deposition of metallic vapors at rates sufficient to bypass crystallization. For the formation of a metallic glass, cooling rates in the range $10^4$–$10^{12}$ K/s are required to suppress nucleation and growth of more stable crystalline phases in undercooled alloy melts. These facts lead to severe restrictions in the synthesis of glassy metals. For example, simple heat transfer considerations require at least one of the specimen dimensions to be rather small, typically $10\mu$–$100\mu$.

Rapid solidification production methods all require a primary stage of generating and quenching the melt and, if necessary, a secondary stage of consolidating the product into a useful form. The primary stage requires rapidly bringing a melt of small cross-section into good contact with an effective heat sink. Several methods have been developed which can be classified as spray methods, chill methods and weld methods.

The spray techniques are preferable to the other methods since the cooling rate is rapid before, during and after solidification, increasing the likelihood of retaining the glassy micro-structure of the quenched, amorphous material. However, the spray methods are inefficient from an energy standpoint, provide very small sized product which must be further processed by consolidation or dispersed in a matrix resin to form a useful composite.

Recently, in patent application Ser. No. 462,441, filed Jan. 31, 1983, U.S. Pat. No. 4,564,396, the disclosure of which is expressly incorporated herein by reference, it was shown that much thicker and larger dimensional materials can be converted to contain metastable amorphous or fine crystalline phases in practical periods of several hours or less. The metastable phases are formed by diffusion of a first alloy component into a second component at a faster rate than the self-diffusion of the first component. Binary couples with high heats of mixing reduce their free energy by reacting to form a mixed amorphous phase. The method is practiced at a low temperature such that the diffusion and reaction to form the amorphous phase proceeds while the formation of crystalline compounds is kinetically bypassed. The method could be practiced by solid state reaction of polycrystalline diffusion couples in thin films, mixture of powders with nucleating agents or by diffusion of a gas into a layer of metal. In a related experiment, Koch et al [Appl. Phys. Lett. 43, 1017 (1983)] demonstrated that mechanical alloying of elemental nickel and niobium powders by high energy ball milling for extended times leads to the formation of an amorphous powder alloy.

Though these techniques result in the formation of larger amorphous particles or layers than are possible by quenching of melts, the particles are still limited in size. Furthermore, the diffusion technique cannot readily be practiced with large particles of the normal commercial size utilized for powder metallurgy since the surface to volume ratio of these powders is relatively small. Also, the natural surfaces of said powders may be inactive or have a kinetic barrier for reaction due to the presence of surface layers of metal oxide. Therefore, the temperatures required to initiate a reaction are too high to favor the growth of an amorphous phase.

STATEMENT OF THE INVENTION

A new method of forming metastable amorphous or fine crystalline alloy phases is provided in accordance with the invention. The method of the invention is not limited to the particle or grain size of the starting materials and does not require rapid cooling of a molten phase. The process of the invention can be practiced with particles of the size utilized in conventional powder metallurgy, e.g., from 10 to 100 microns.

In the process of the invention, bulk metastable alloys are synthesized by reacting at low temperature cold-worked, mechanically deformed solid metal precursors such as metal powder mixtures or intercalated foil layers. At least one of the precursors is in the form of an individual, discrete, solid unit such as a film, foil, sheet, grain, sphere or rod. Mechanical deformation serves to (1) consolidate the metals in the mixture or foil layers: (2) increases the interfacial area between the two or more metals; and (3) reduces at least one of the characteristic dimensions of the mixture.

During mechanical deformation, the grains of powder or the foil mechanically deform into a lamellar, filamentary structure. An intermediate is produced in the form of a filamentary composite. Each grain is elongated by cold-working in absence of heat into linear filaments. The composite contains a physical mixture of the two or more metals in filamentary form. The fairly thick powder grains or foils, typically 10 to 100 microns having a small surface to volume ratio, are converted into a filament form having a very high surface/volume ratio. The thickness of each filament also is substantially decreased by a factor of at least 10 to $10^4$ to values of less than 0.01 micron up to 10 microns or more. Therefore, the diffusion distance for reaction is reduced as is the time for conversion to a metastable phase.

During deformation the defect concentration is substantially increased while a substantial amount of fresh internal surface area is created. Therefore, the relative amount of internal surface area covered by oxide or contamination decreases. All of these factors increase the surface area for reaction as well as the reactivity of the pure metal components on each surface. The freshly sheared interface between the grains is now in a much more clean and reactive state for growth of an amorphous phase. The compacted, deformed metals are in intimate contact for reaction.

The metals react beginning at the interface with the faster diffusing metal diffusing through a newly formed amorphous interlayer formed under isothermal conditions. The reaction proceeds at relatively low temperatures and in short time periods to form metastable amorphous and/or fine grained poly-crystalline phases. At intermediate stages of reaction the amorphous phase is therefore dispersed throughout the remaining unreacted material to form a composite of hard amorphous material in a softer metal matrix. At intermediate stages the composite is ductile and can be bent to a moderate degree without fracture.

The present invention provides amorphous alloys from conventional available forms of the pure metals. The crystallization and glass transition temperatures of the amorphous phases formed by this solid state reaction are nearly identical to those of an amorphous alloy of similar composition prepared by rapid quenching. The method of the invention can also be practiced with starting materials other than powders such as foils or wires. A wire of one metal could be embedded in a bulk rod of a second metal or wires could be twisted, braided or woven before cold-rolling or swaging into a sheet. Various deformation methods such as drawing, profile rolling, extrusion and the like could be employed to carry out the deformation step.

At more elevated temperatures, crystalline compound phases, some of which are metastable, have been observed to form in addition to the amorphous phase. The final phases can combine to provide unusual mechanical properties for the reacted composite. The deformation reduction ratios can be extended to reduce the filament diameter of the grains to atomic dimensions. Total direct conversion to an amorphous alloy by deformation only may be possible. In any case, conversion of the thin foils to an amorphous state will require very short thermal treatment times when the filament dimensions are extremely small.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
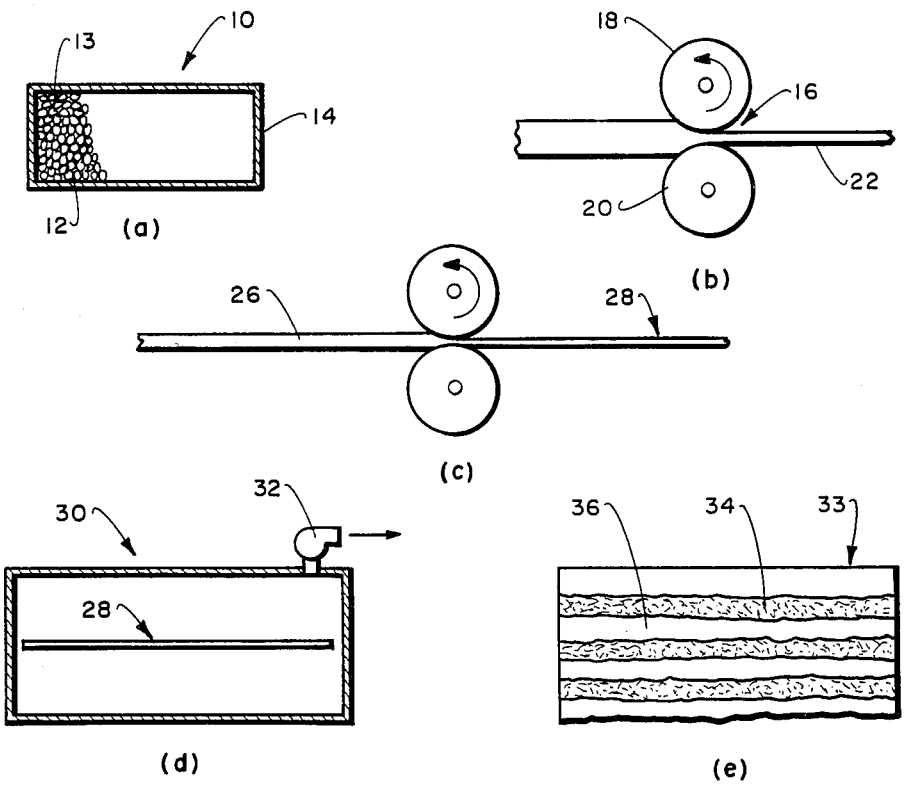
FIG. 1 is a schematic view of a deformation-alloying method of the invention.

Referring now to FIG. 1 in one embodiment of the process of the invention a disc 10 is prepared containing a compacted mixture 12 of polycrystalline grains 13 of the metals to be alloyed. The mixture is clad in an inert deformable container 14. The mixing and compacting are conducted in an inert atmosphere. The mixture remains unheated during this initial processing. Compacting can be done by physically tamping or pressing the mixture or by use of acoustic energy or shock waves to consolidate the mixture.

The disc 10 is then deformed to reduce its thickness by a factor of at least 10. Suitably, the disc 10 is cold-rolled between the nip 16 of rollers 18, 20 in a series of passes to form a flattened disc 22. Refering now to FIG. 4 during cold-rolling, the powder grains 13 are flattened and deform into a lamellar filamentary structure 17 during this step, the thickness of the grains 13 reduced by about the same ratio as the disc. The flattened foil 26 is now removed from the deformable container 14. The foil 26 is further deformed by additional rolling to a final reduction of at least 100 to form a very thin sheet or foil 28 having a composite structure containing even thinner lamellae. The thickness of the lamellae should be from 0.01 μm to 10 μm microns to provide near complete reaction (80 percent amorphous or other desirable or metastable by-product) in periods under 100 hours, preferably in periods of less than 24 hours. The structure of the foil 28 remains polycrystalline but contains a much higher density of crystal defects such as dislocation.

Figure 2:
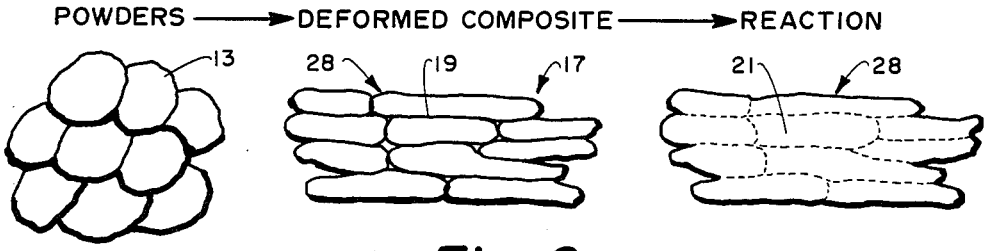
FIG. 2 is a schematic view of the deformation-alloying process of the invention.
Figure 3:
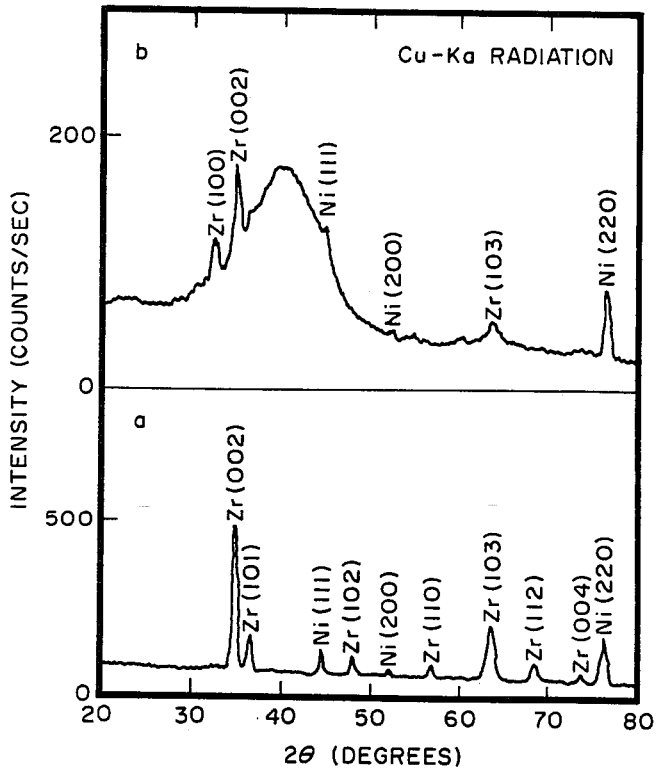
FIG. 3 are x-ray diffraction patterns of a $Ni_{62}$-$Zr_{38}$ composite (a) as rolled and (b) reacted at 260° C. for 14 hours.

The foil 28 is then thermally treated in an oven 30 under high vacuum from pump 32 for times ranging from 1 hour to several days at a temperature at which the rate of formation of metastable phases is much higher than the rate of forming stable, crystalline phases. Referring again to FIG. 2 the foil 28 reacts at the freshly formed boundaries 19 to form metastable amorphous or crystalline material 21. A large fraction, from 60 to 100 percent, usually 70 to 90 percent, reacts to form the metastable phase. As shown in FIG. 3, a sheet 33 which is a composite of the metastable material 34 dispersed in the remaining unreacted polycrystalline material 36 is produced.

The method of the invention can be practiced on any of the anomalous fast diffusion systems as disclosed in patent application Ser. No. 462,441, filed Jan. 31, 1983, U.S. Pat. No. 4,564,396, the disclosure of which is expressly incorporated herein by reference. In these systems, a temperature range exists in which nucleation and growth of thermodynamically stable crystalline phases occurs at a substantially lower rate than the nucleation and (or) growth of thermodynamically metastable amorphous or metastable crystalline phases.

Empirical criteria have been established which allows one to identify those systems (binary, ternary, or of high order) that are most favorable for reacting into metastable phases. These criteria have been further developed to enable one to identify the temperature regime suitable for performing this action.

For the case of reacting two constituents A and B to form a metastable phase, the criteria to be followed are: (a) at the reaction temperature one of the components, say B, must diffuse in the other, component A, through a distance comparable to the dimensions of the starting constituents in practical time periods. This establishes a lower bound $T_L$ for the reaction temperature; (b) the reaction temperature must be lower than the transformation temperature at which the metastable phase to be formed is known to transform into one or more of the more stable crystalline phases. This establishes an upper bound $T_X$ for the reaction temperature. Only when $T_X$ is significantly greater than $T_L$ does a workable temperature regime exist. In practice it has been found that these criteria can be satisfied in systems where the diffusion constant of B in A exceeds the self-diffusion constant of A in A by 2 or more orders of magnitude in the temperature range of interest (between $T_L$ and $T_X$).

There are two general classes of binary systems in which formation of amorphous compounds is observed. Compounds AZ in whch A is an early transition metal (ETM) and Z is a late transition metal (LTM) and Z is also the fast diffusing species in A. ETM can be selected from Groups IIIB, IVB or VB of the Periodic Table of Elements and LTM can be selected from Groups VIIB, VIII or IB. Representative AZ binary systems are YCu, YCo, ZrCu, ZrNi, ZrCo, TiNi, NbNi and AuLa.

Amorphous materials can also be formed in binary systems of transition metals selected from Groups IB, VB, VIB, VIIB or VIII with a metalloid selected from Groups IIIA, VIA or VA.

Based on the criteria presented above, a survey of the literature on diffusion and amorphous phase formation has been conducted and metastable forming compositions of the formula $A_{1-x}Z_x$ which satisfy the criteria are presented in the following table:

TABLE 1

| Host Metal A | Fast Diffusing Metal Z in Host A | Glass Forming Alloy $A_{1-x_0}Z_{x_0}$ |
|---|---|---|
| Zr (zirconium) | Cu (copper) | $0.25 < x_o < 0.65$ |
| | Ni (nickel) | $0.30 < x_o < 0.60$ |
| | Co (cobalt) | $0.25 < x_o < 0.50$ |
| | Fe (iron) | $0.20 < x_o < 0.40$ |
| Ti (titanium) | Cu | $0.30 < x_o < 0.60$ |
| | Ni | $0.30 < x_o < 0.50$ |
| | Co | $0.25 < x_o < 0.40$ |
| | Fe | $0.25 < x_o < 0.40$ |
| La (lanthanum) | Au (gold) | $0.20 < x_o < 0.35$ |
| | Ag (silver) | $0.20 < x_o < 0.35$ |
| | Cu | $0.25 < x_o < 0.35$ |
| | Ni | $0.25 < x_o < 0.40$ |
| Y (Yittrium) | Cu | $0.25 < x_o < 0.40$ |
| | Ni | $0.25 < x_o < 0.40$ |
| | Co | $0.25 < x_o < 0.40$ |
| | Fe | $0.25 < x_o < 0.40$ |
| Fe (Iron) | B (boron) | $0.10 < x_o < 0.30$ |
| | C (carbon) | — |
| | P (phosphorous) | $0.15 < x_o < 0.25$ |
| Ni (nickel) | B | $0.15 < x_o < 0.40$ |
| | C | — |
| | P | $0.15 < x_o < 0.30$ |
| Co (cobalt) | B | $0.15 < x_o < 0.30$ |
| | C | — |
| | P | $0.15 < x_o < 0.30$ |

The Ni-Zr and Cu-Zr binary systems are exemplified. Solid state reactions in the Ni-Zr system without cold-working have been previously reported by Clemens et al, J. Non-Cryst. Sol., 61 & 62, 817 (1983). There has not been any report of formation of amorphous Cu-Zr but the system is very similar to the Ni-Zr system. Samples were prepared by compaction and cold-rolling a sealed can of binary powder or a jacketed spiral wound set of metal foils.

EXAMPLE 1

Polycrystalline powders of Zr-metal and Ni-metal having grain size of about 40 μm were physically mixed thoroughly and compacted in an inert argon atmosphere to form disks of thickness $\frac{1}{8}''$–$\frac{1}{4}''$ in diameter $\frac{3}{8}''$. The disks were sealed by vacuum electron-beam welding in a stainless steel container. The sample remains unheated during this initial processing step. The container is subsequently flat rolled in a series of progressive steps reducing its thickness by a factor of about 8. The powder grains are deformed into a lamellar filamentary structure during this processing step. The foil sample is removed from the container and is further deformed by additional rolling in 10–12 passes to a final reduction of about $3 \cdot 10^4$ as follows:

1. folding the foil to double its thickness,
2. rolling it in between two 0.75 mm thick stainless steel plates to the limit of the rolling mill.

EXAMPLE 2

Ni-Zr and Cu-Zr samples were made by winding two annealed elemental foils of ~10 microns thickness in spiral form and the cold-rolling them in a stainless steel jacket. The foils obtained were removed from their containers and subsequently processed 10–12 passes as described in Example 1.

Figure 4:
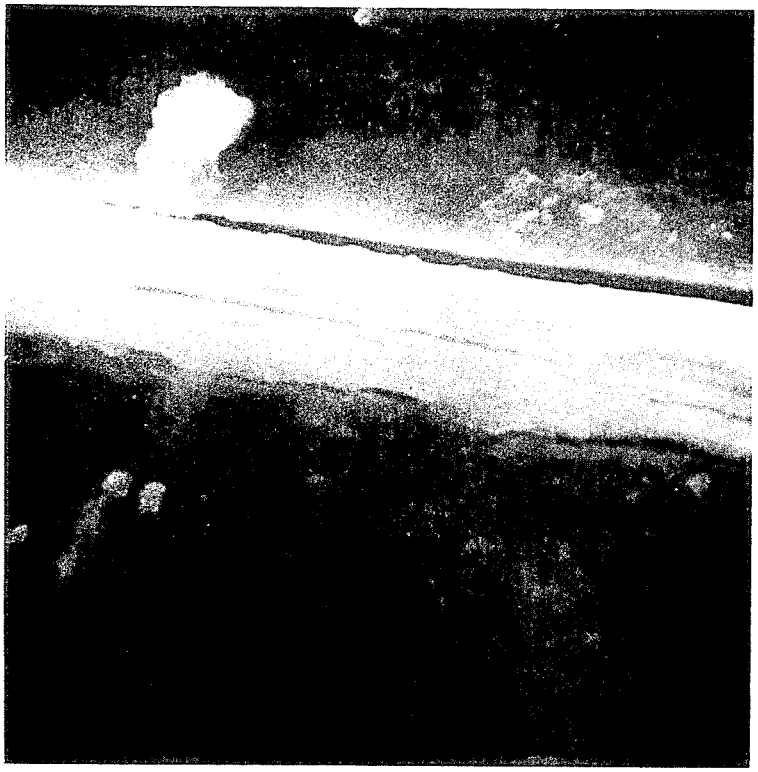
FIG. 4 is a scanning electronmicrograph of a cold-rolled Ni-Zr sheet prepared from powder.

The scanning electronmicrograph of FIG. 4 shows a cross-section of the Ni-Zr sample prepared in Example 1 by the powder metallurgical technique.

The material remains polycrystalline but contains a high density of defects. Individual lamellae consisting of about 1000 Å thick Ni and Zr layers can be seen. FIG. 4 shows an x-ray diffraction pattern of an as-rolled $Ni_{62}Zr_{38}$ composite, taken with a vertical diffractometer in reflection geometry. In this configuration, the x-ray scattering vector K is perpendicular to the foil surface. The Scherrer formula allows one to estimate the typical size t (parallel to K) of an individual microcrystal as $$t = 0.9\lambda / B \cos \theta$$

where λ is the wavelength of the radiation, B is the line width and $2\theta$ is the scattering angle. This microcrystal size is a lower bound on the lamella thickness since the thickness of the lamella must contain at least one microcrystal. The instrumental line broadening was measured with a single crystal and found to be 0.15 degrees. After appropriate account of the instrumental broadening was taken, t values of 500 Å and 600 Å were obtained for Zr and Ni, respectively. For the copper in Cu-Zr, t is equal to 250 Å. In both Ni-Zr and CuZr composites, strong texture is observed. For Ni ard Cu, the relative intensity of the (220) lines is higher than expected for the diffraction pattern of a randomly distributed powder. This is consistent with the description of the texture in cold-rolled face centered cubic metals given in the literature. Among the Bragg peaks corresponding to zirconium, the (100) is barely present before the reaction while the (002) is relatively intense.

The composites are then subjected to an annealing thermal treatment to convert the elongated polycrystalline grains to a metastable amorphous state by solid state reaction.

Prior to annealing the sample foils were sealed under vacuum in pyrex tubes containing Zr getters, which were separately heated above 500° C. for 10 hours while the samples remained at ambient temperature. Then the samples were annealed at high vacuum ($\sim 10^{-6}$ torr) at temperatures ranging from 250° C. to 370° C. for times of 1 to 32 hours. For both Ni-Zr and Cu-Zr, crystalline intermetallic compounds were obtained at annealing temperatures above 280° C. As observed with x-ray difraction.

FIG. 3*b* shows the x-ray diffraction pattern in the same geometry as in FIG. 3*a* for a $Ni_{62}Zr_{38}$ sample, reacted at 260° C. for 14 hours. A broad diffuse diffraction maximum (width ~10 degrees) is observed in a range of K-values, in which no Bragg peaks were present before the reaction. The original Ni and Zr phases are not completely reacted, as can be seen from the remaining peaks. The fraction of unreacted material can be estimated from the ratio of the area under the Bragg peaks to the area under the diffuse maximum. It is approximately 20 percent. For a reaction time of 32 hours at the same temperature, little further growth of the amorphous phase is observed, but one or more crystalline intermetallic compounds are formed. There still remains some elemental material. The incompleteness of the reaction can have several causes: surface oxides or other contaminants may be present on some interfaces and act as diffusion barriers; the occurrence of several adjacent layers of the same metal could lead to rather thick regions of one metal. Thus, much longer times would be required to react these regions. In such long times, crystalline compounds are observed to form and, thus, a completely amorphous by-product is precluded.

DSC was performed on several samples of $Ni_xZr_{1-x}$ ($x=62$, 68; reacted at 270° C. for 8–16 hours) and $Cu_{60}Zr_{40}$ reacted at 275° C. for 16 hours. For all Ni-Zr samples an exothermic peak at 550°–565° C. was obtained for a heating rate of 20° C./min. X-ray diffraction patterns of a sample heated to 500° and cooled rapidly show the presence of a new crystalline intermetallic compound and a remaining amorphous phase. This compound is likely to be a result of the completion of the reaction of the pure zirconium and nickel. After heating the sample to 570° C. and cooling it down, the x-ray diffraction pattern shows no remaining amorphous material and a new set of Bragg peaks. The exothermic peak is attributed to the crystallization of the amorphous phase. The result for the crystallization temperature Tx is in close agreement with the value reported for Ni-Zr metallic glasses produced by rapid quenching. Tx has a maximum as a function of composition equal to 575° C. at 64 atomic percent nickel. Preliminary results for $Cu_{60}Zr_{40}$ yield an endothermic peak at 440° C. and two sharp exothermic peaks at 475° C. and 500° C., respectively. The endothermic peak is characteristic of a glass transition. A glass transition temperature Tg of 450° C. and a crystallization temperature of 490° C. have been reported for the rapidly quenched metallic glass $Cu_{60}Zr_{40}$. The values of Tg and Tx determined for the samples of the invention are again in close agreement with those obtained for rapidly quenched glasses.

In summary, the feasibility of solid-state reactions for synthesizing amorphous alloys in three dimensions has been demonstrated. For the first time, thermal analysis of the product of such reaction has become possible, and the results indicate that the crystallization and glass transition temperature of the amorphous phases formed by respectively solid-state reaction and rapid quenching of an alloy of similar composition are nearly identical.

It is to be realized that only preferred embodiments of the invention have been described and that numerous substitutions, modifications and alterations are permissible without departing from the spirit and scope of the invention as defined in the following claims.

We claim:

1. A method of forming solid, metastable, amorphous metal materials comprising the step of:

forming a mixture of solid, metal precursors of the metastable, amorphous material, at least one of the precursors being in the form of individual, discrete, solid units and said mixture containing metals A and Z where A is an early transition metal selected from Group IIIB, IVB, or VB and Z is a late transition metal selected from Group VIIB, VIII or IB or the mixture is formed of a transition metal selected from IB, VIB, VIIB or VIII with a metalloid selected from Group IIIA, IVA, or VA;

consolidating the mixture by cold working the consolidated mixture to reduce the thickness of the said discrete units of precursor by a factor of at least 10; and heating the cold-worked mixture at a temperature lower than the transformation temperature at which the metastable phase transforms into a more stable crystalline phase for a time sufficient to form a solid, metastable, amorphous, metal material.

2. A method according to claim 1 in which the metastable amorphous metal material is selected from YCu, YCo, YAu, YNi, YFe, ZrFe, ZrCu, ZrNi, ZrCo, TiNi, TiFe, TiCu, NbNi or AuLa.

3. A method according to claim 1 in which the unit is selected from the group consisting of films, foil, sheets, grains, spheres or rods.

4. A method according to claim 3 in which the mixture is cold-worked to reduce the thickness of at least one of the precursor units by a factor of at least 100.

5. A method according to claim 4 in which the mixture is cold-worked to deform at least one precursor unit into a lamellar or filamentary structure.

6. A method according to claim 5 in which the thickness of the lamella or filaments is reduced to 100 microns or less.

7. A method according to claim 6 in which the thickness of the lamella is no more than 10 microns.

8. A method according to claim 7 in which the thickness of the lamella is no more than 1 micron.

9. A method according to claim 1 in which the consolidatedd assembly is covered with an inert, deformable container.

10. A method according to claim 1 in which the container is a layer of metal cladding.

11. A method according to claim 1 in which the heating is conducted in an inert environment.

12. A method according to claim 11 in which the ratio of the rate of forming metastable material to the rate of forming stable crystalline phases is at least $10^2$.

13. A method according to claim 12 in which said ratio is at least $10^4$.

14. A method according to claim 3 in which the assembly comprises grains of metals having a particle size of 10 to 100 microns.

15. A method according to claim 3 in which the discrete units are in the form of foils or powders.

* * * * *